US006145762A

United States Patent [19]

Orloff et al.

[11] Patent Number: 6,145,762

[45] Date of Patent: Nov. 14, 2000

[54] VARIABLE RATE SPRING FOR A FUEL INJECTOR

[75] Inventors: Weston F. Orloff; Calvin Yates, both of Columbus, Ind.

[73] Assignee: Cummins Engine Company, Inc., Columbus, Ind.

[21] Appl. No.: 09/174,847

[22] Filed: Oct. 19, 1998

[51] Int. Cl.[7] ..... F02M 59/00

[52] U.S. Cl. ..... 239/533.2; 239/88; 239/90; 239/533.9; 267/180

[58] Field of Search ..... 239/88, 90, 533.2, 239/533.9; 267/167, 180

[56] References Cited

U.S. PATENT DOCUMENTS

| | | | |
|---|---|---|---|
| 3,409,225 | 11/1968 | Maddalozzo et al. | 239/89 |
| 3,751,025 | 8/1973 | Beery et al. | 267/180 X |
| 4,111,407 | 9/1978 | Stager | 267/166 |
| 4,537,359 | 8/1985 | Skinner | 239/533.6 |
| 4,573,659 | 3/1986 | Homes | 251/129.02 |
| 4,715,542 | 12/1987 | Morell et al. | 239/533.9 |
| 4,970,997 | 11/1990 | Inoue et al. | 267/166 X |
| 5,102,047 | 4/1992 | Rossignol | 239/88 |
| 5,647,540 | 7/1997 | Buckley | 239/533.2 |
| 5,871,154 | 2/1999 | Hardy | 239/88 |
| 5,871,155 | 2/1999 | Stockner et al. | 239/88 X |
| 5,894,991 | 4/1999 | Edwards et al. | 239/88 |

FOREIGN PATENT DOCUMENTS

| | | | |
|---|---|---|---|
| 55-69754 | 5/1980 | Japan | F02M 61/04 |
| WO 94/20750 | 9/1994 | WIPO | F02M 61/20 |

*Primary Examiner*—Andres Kashnikow
*Assistant Examiner*—Robin O. Evans
*Attorney, Agent, or Firm*—Woodard, Emhardt, Naughton, Moriarty & McNett

[57] ABSTRACT

A fuel injector for use in a diesel engine which is equipped with an engine brake governed by a hydraulic circuit includes an injector body with a hollow interior, a plunger located within the injector body, a moveable coupling positioned within the injector body, a nozzle for the dispensing of fuel, and a variable rate return spring which is positioned between the injector body and the moveable coupling. The variable return spring is designed with a variable pitch between adjacent coils such that the pitch between coils near the end(s) of the spring is reduced over that near the center of the spring. The use of the variable rate spring is intended to address the problem of premature fatigue failures caused by the return spring oscillating at or above its natural frequency. The oscillations are induced due to the exhaust valve opening and closing events and are transmitted directly through the engine brake hydraulic circuit to the injectors by way of the injector push tube. With the variable rate spring, if resonance occurs at one harmonic, the end coils close and open up, thus changing the natural frequency of the spring and tending to throw it out of resonance. In this manner, the spring will not oscillate at its natural frequency since the natural frequency is changing.

10 Claims, 4 Drawing Sheets

VARIABLE RATE SPRING FOR A FUEL INJECTOR

BACKGROUND OF THE INVENTION

The present invention relates in general to diesel engine fuel injectors and the return spring which comprises one component part of most fuel injector designs. More specifically, the present invention relates to the use of a return spring with a variable spring rate in order to vary the natural frequency of the spring and thereby reduce the chances for premature fatigue failure.

Typically, fuel injector designs of the past several years have included a coil spring component which functions as a return spring for the follower. Such springs were designed so as to last as long as the designed life of the injector so that spring failure would not be the cause of injector failure.

More recently, some diesel engines have been equipped with hydraulic engine brakes which employ a hydraulic circuit including pistons, fluid passageways, and a direct interface with the exhaust valves of the engine The design of an engine brake is intended to slow the engine by keeping the exhaust valves open (approximately 0.007 inches (0.178 mm)) during the compression stroke of the engine.

What has been learned is that fuel injectors, which are part of diesel engines equipped with engine brakes, are prematurely failing due to failed (broken) return springs. As this data has been generated and gathered, there have been attempts to solve the return spring failure problem (i.e., the noticeable increase in failure rate), which appears to be limited to those diesel engines which are equipped with hydraulic engine brakes. It is believed that all prior attempts at solving this spring failure problem have focused on increasing the durability of the spring, basically making a stronger spring with a greater design margin. In effect, these prior attempts focused on lowering the stress level seen within the spring, but these attempts for the most part have proven to be ineffective.

Further study of the spring failure problem by the present inventors showed that the fuel injector return spring was oscillating severely at its natural frequency when the hydraulic engine brake was applied. The amplitude of this oscillation was severe enough to increase the stress range of the spring and eventually cause a fatigue failure. The return spring was actually operating outside of its design limits during the braking event. The spring was excited at or above its natural frequency due to an interaction with the engine brake. During the engine brake cycle, the exhaust valve opening and closing events were transmitted directly through the engine brake hydraulic circuit to the injector by way of the injector push tube. The forces and vibrations which are transmitted are sufficient to excite the spring at or above its natural frequency.

The present invention solves the problem of return spring fatigue failure by replacing the traditional injector return spring with a spring having a variable rate. The variable rate is created by reducing or varying the pitch of the coils near the end(s) of the spring. If resonance occurs with one harmonic, the end coils will close up, thus changing the natural frequency of the spring and tending to throw it out of resonance.

While the use of a variable pitch spring (i.e., variable rate) is known for use in conjunction with valves for internal combustion engines, no use of this concept has ever been attempted for solving a premature failure problem of injector springs due to an engine brake hydraulic circuit. In order to control stresses due to resonant vibrations in valve springs, several methods have been tried over the years, including making the natural frequency of the spring higher, modifying the cam contour, and reducing or varying the pitch of the spring coils near the ends of the spring. The prior use of this last option has been limited to valves due to the specific problems and issues represented by valves. It is not an obvious next step to use this particular spring design technique in order to redesign a fuel injector.

SUMMARY OF THE INVENTION

A fuel injector for use in a diesel engine which is equipped with an engine brake governed by a hydraulic circuit according to one embodiment of the present invention comprises an injector body having a hollow interior, a plunger located within the injector body, a moveable coupling positioned within the injector body, a nozzle for the dispensing of fuel, and a variable rate return spring positioned between the injector body and the moveable coupling such that movement of the coupling into the hollow interior of the injector body compresses the variable rate return spring.

One object of the present invention is to provide an improved fuel injector by using a variable rate spring in order to preclude premature fatigue failure of the spring.

Related objects and advantages of the present invention will be apparent from the following description.

DESCRIPTION OF THE PREFERRED EMBODIMENT

Figure 1:
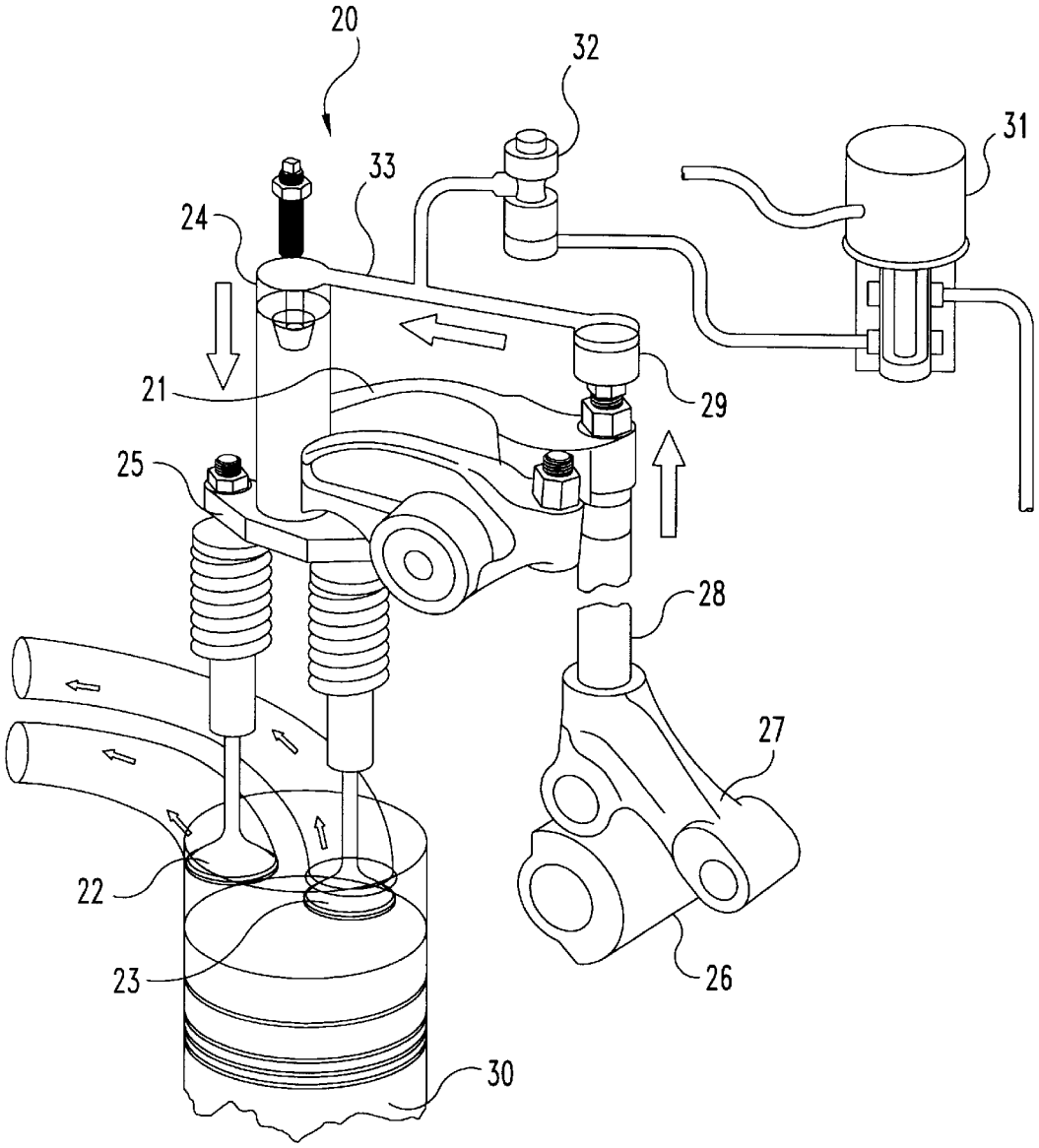
FIG. 1 is a diagrammatic, perspective view of an engine brake which is governed by a hydraulic circuit and provides background disclosure for the present invention.

For the purposes of promoting an understanding of the principles of the invention, reference will now be made to the embodiment illustrated in the drawings and specific language will be used to describe the same. It will nevertheless be understood that no limitation of the scope of the invention is thereby intended, such alterations and further modifications in the illustrated device, and such further applications of the principles of the invention as illustrated therein being contemplated as would normally occur to one skilled in the art to which the invention relates.

Referring to FIG. 1, there is diagrammatically illustrated an engine brake 20 for a diesel engine which includes a cooperating and governing hydraulic circuit. Engine brake 20 uses a hydraulic link (engine oil) between the injector rocker lever 21 and the exhaust valves 22 and 23. The upward motion of the master piston acting on the injector rocker lever 21 creates high pressure in a closed oil passage. The slave piston 24 is at the other end of this passage, and is hydraulically depressed onto the exhaust crossover plate 25, keeping the exhaust valves 22 and 23 open approximately 0.007 inches (0.178 mm) during the compression stroke of the corresponding diesel engine (not illustrated). The primary components of the FIG. 1 illustration includes one cam 26 of the traditional or conventional cam shaft, the cam follower 27, the push tube 28, the master piston 29, the injector rocker lever 21, the slave piston 24, the crossover plate 25, the exhaust valves 22 and 23, and the cylinder 30. Also included are other hydraulic components which cooperatively function with the engine brake. Included is a solenoid valve 31 which controls the flow of oil into and out of the hydraulic circuit and a control valve 32 which governs the delivery of oil to the oil passage 33 connecting the two pistons.

Figure 2:
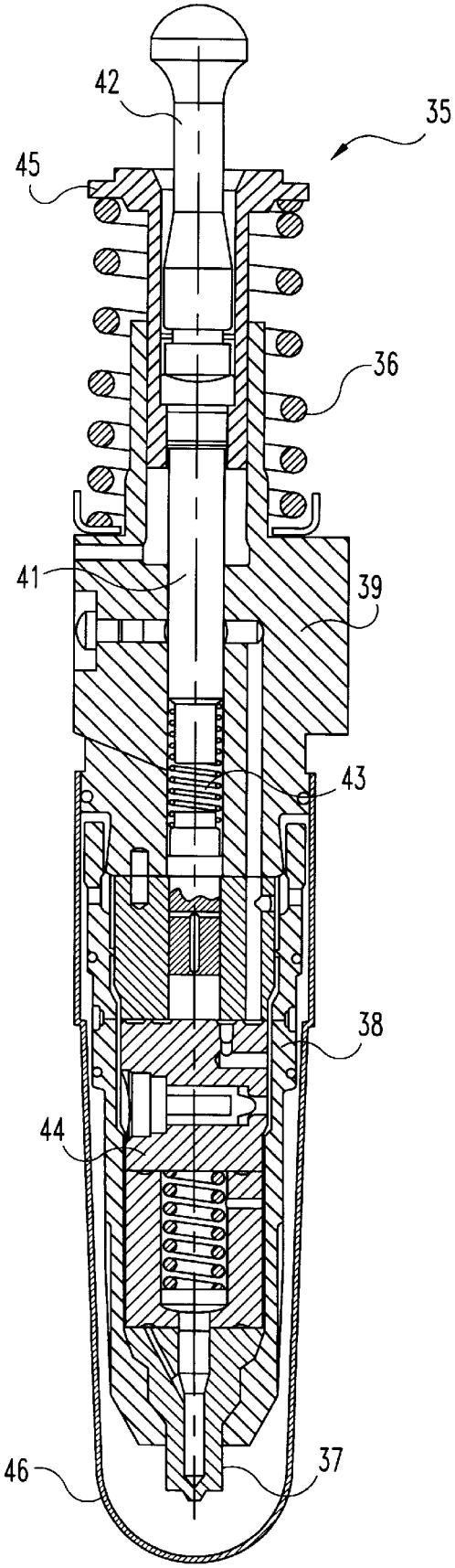
FIG. 2 is a side elevational view in full section of a fuel injector incorporating a variable rate return spring according to a typical embodiment of the present invention.
Figure 3:
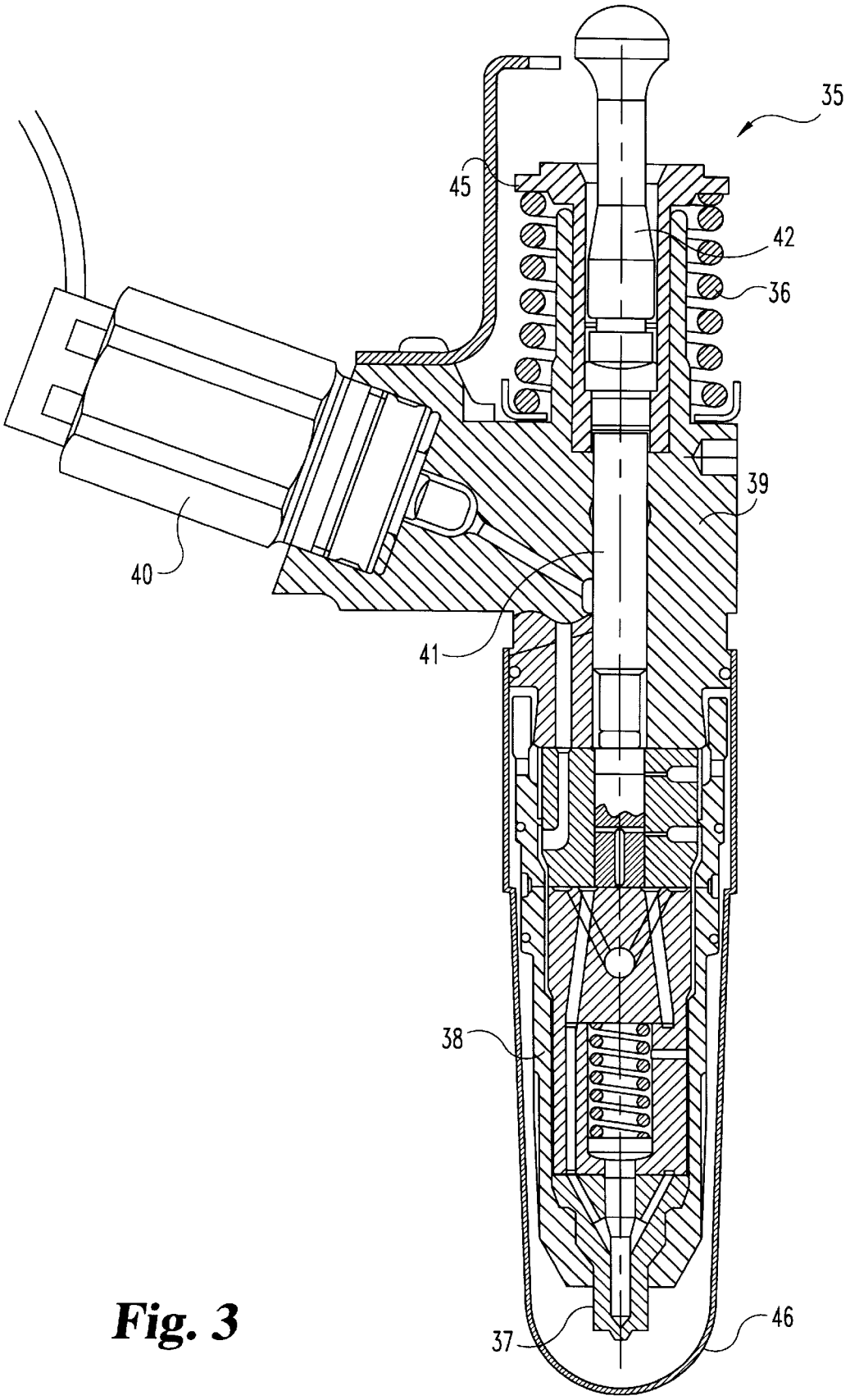
FIG. 3 is a side elevational view in full section of the FIG. 2 fuel injector and variable rate return spring as viewed through a different cutting plane.

Referring to FIGS. 2 and 3, there is illustrated a fuel injector 35 for a diesel engine which includes a variable rate return spring 36 (see FIG. 4) designed according to the present invention. The fuel injector includes, in addition to return spring 36, nozzle 37, retainer 38, injector body 39, control valve 40, plunger 41, link 42, spring 43, spacer 44, coupling 45, and protective cover 46.

Fuel injector 35 includes a number of other features and component parts. However, the design and operation of this style of fuel injector is well known and the specific design features, other than for spring 36, are not the focus of the present invention. What is depicted by FIGS. 2 and 3 is a fuel injector with an injector body 39 which defines a hollow interior. The plunger 41 is positioned in the hollow interior and is moveable by means of link 42. The moveable coupling 45 also fits in the hollow interior of the injector body 39 and is moveable relative to the injector body 39.

In FIG. 2 the variable rate return spring 36 is extended to at or near its free length and is positioned between the moveable coupling 45 and the injector body 39. As the link 42 is pushed into the hollow interior, it acts on the plunger 41 and pushes down on the coupling, moving if farther into the hollow interior of the injector body. As the coupling moves, it acts on the top of spring 36, compressing the spring to the configuration of FIG. 3. When the link is free to return to its starting position, spring 36 performs the return function.

It has been discovered that the valve opening and closing events during the engine brake cycle are transmitted directly through the engine brake hydraulic circuit to the fuel injector 35 by way of the injector push tube. The load spikes which are transmitted due to the valve opening and closing events are enough to induce a natural frequency oscillation in a conventional return spring (not illustrated). When this conventional return spring is replaced with the variable rate spring 36, according to the present invention, the natural frequency of the spring changes as the spring is compressed. Spring 36 is designed with variable spacing between spring coils with the pitch of the coils near the ends of the spring reduced as compared to the center coils. Any engine brake induced oscillation which does occur is quickly dampened out as the natural frequency of the spring changes. The result is that engine brake induced spring fatigue failures are effectively eliminated, providing increased reliability and durability over the current return spring.

Figure 4:
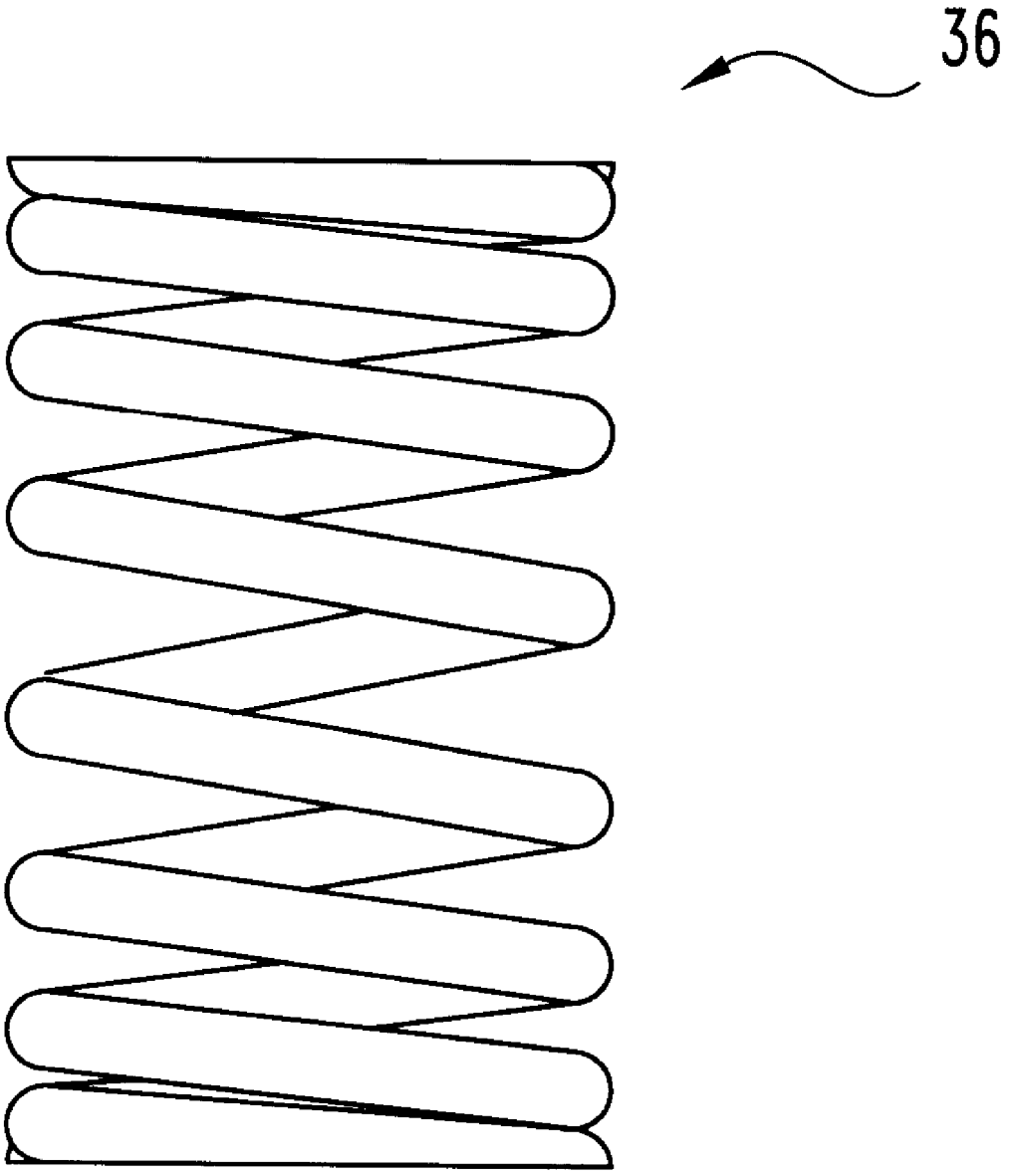
FIG. 4 is a front elevational view of a variable rate return spring suitable for use in the FIG. 2 fuel injector according to the present invention.

Referring to FIG. 4, return spring 36 is depicted as a typical coil spring with a uniform wire diameter, but with a specific configuration as to the spacing between coils such that the coil-to-coil pitch is different from the center of the spring in the direction of each end. The pitch is reduced at or near the end(s). In fact, the first coil at each end is in contact with the second coil at each end. As an alternative, the reduced pitch coils can be placed at only one end of the spring. In this case, the spring must be installed with the reduced pitch coils on the non-moveable end of the spring, as assembled into the injector. The wire diameter for spring 36 is approximately 4.3 mm. The outside diameter is approximately 31.96 mm and the inside diameter is approximately 23.36 mm. The free length of spring 36 is approximately 56.27 mm.

While variations in the length, coil diameter, wire diameter, and coil pitch are contemplated, depending on the injector design and the specifics of the engine brake and the hydraulic circuit, the key is the use of a variable rate spring. When this spring is combined with a fuel injector, as used on a diesel engine with an engine brake, the harmful oscillations at the natural frequency of the spring are eliminated. In turn, this eliminates the premature fatigue failures which otherwise occur with constant rate return springs.

While the invention has been illustrated and described in detail in the drawings and foregoing description, the same is to be considered as illustrative and not restrictive in character, it being understood that only the preferred embodiment has been shown and described and that all changes and modifications that come within the spirit of the invention are desired to be protected.

What is claimed is:

1. A fuel injector for use in a diesel engine which is equipped with an engine brake governed by a hydraulic circuit, said fuel injector comprising:

an injector body having a hollow interior;

a plunger located within said injector body;

a moveable coupling having a portion which is positioned within the injector body;

a link member engaging said plunger and having a first end extending beyond a first end of said moveable coupling;

a nozzle for the dispensing of fuel; and a variable rate return spring positioned between said injector body and said moveable coupling such that a force applied to said link member causes movement of said plunger into said injector body and movement of said moveable coupling toward said injector body which causes the compression of the variable rate return spring.

2. The fuel injector of claim 1 wherein said variable rate spring has a variable pitch between adjacent spring coils.

3. The fuel injector of claim 2 wherein said variable rate return spring has a wire diameter of between 2.0 mm and 6.0 mm.

4. The fuel injector of claim 3 wherein said variable rate return spring has a free length of between 50 mm and 63 mm.

5. The fuel injector of claim 1 wherein said variable rate return spring has a first coil section with a first coil pitch spacing at a first end, a second coil section with a second coil pitch spacing at a second end, and a third coil section positioned between said first end and said second end with a third coil pitch spacing, said first coil pitch spacing and said second coil pitch spacing being the same and being smaller than said third coil pitch spacing.

6. A fuel injector for use in an engine which is equipped with an engine brake, said fuel injector comprising:

an injector body having a hollow interior;

a plunger located within said injector body;

a moveable coupling having a portion which is positioned within the injector body;

a link member engaging said plunger and having a first end extending beyond a first end of said moveable coupling;

a nozzle for the dispensing of fuel; and a variable rate return spring positioned between said injector body and said moveable coupling such that a force applied to said link member causes movement of said plunger into said injector body and movement of said moveable coupling toward said injector body which causes the compression of the variable rate return spring.

7. The fuel injector of claim 6 wherein said variable rate spring has a variable pitch between adjacent spring coils.

8. The fuel injector of claim 7 wherein said variable rate return spring has a wire diameter of between 2.0 mm and 6.0 mm.

9. The fuel injector of claim 8 wherein said variable rate return spring has a free length of between 50 mm and 63 mm.

10. The fuel injector of claim 6 wherein said variable rate return spring has a first coil section with a first coil pitch spacing at a first end, a second coil section with a second coil pitch spacing at a second end, and a third coil section positioned between said first end and said second end with a third coil pitch spacing, said first coil pitch spacing and said second coil pitch spacing being the same and being smaller than said third coil pitch spacing.

* * * * *